US007697866B2

(12) United States Patent
Murayama

(10) Patent No.: US 7,697,866 B2
(45) Date of Patent: Apr. 13, 2010

(54) IMAGE FORMING APPARATUS AND IMAGE CARRIER UNIT WITH GEARS FOR DRIVING IMAGE CARRIERS

(75) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 331 days.

(21) Appl. No.: 11/711,609

(22) Filed: Feb. 28, 2007

(65) Prior Publication Data

US 2007/0201900 A1 Aug. 30, 2007

(30) Foreign Application Priority Data

Feb. 28, 2006 (JP) ..... 2006-053065

(51) Int. Cl.
*G03G 15/00* (2006.01)

(52) U.S. Cl. ..... 399/110; 399/167

(58) Field of Classification Search ..... 399/110, 399/111, 113, 119, 167
See application file for complete search history.

(56) References Cited

U.S. PATENT DOCUMENTS 6,708,011 B2 3/2004 Nomura et al.
6,944,415 B2 9/2005 Nomura et al.
6,978,103 B2 12/2005 Miura et al.
2002/0172532 A1* 11/2002 Senda ..... 399/167
2005/0147432 A1 7/2005 Miura et al.

FOREIGN PATENT DOCUMENTS

| | | |
|---|---|---|
| JP | 2003015378 | 1/2003 |
| JP | 2003043776 | 2/2003 |
| JP | 2003057947 | 2/2003 |
| JP | 2003255660 | 9/2003 |
| JP | 2003280313 | 10/2003 |
| JP | 2003280491 | 10/2003 |
| JP | 2003287992 | 10/2003 |
| JP | 2003316105 | 11/2003 |
| JP | 2003316233 | 11/2003 |
| JP | 2004109455 | 4/2004 |

* cited by examiner

*Primary Examiner*—Hoang Ngo
(74) *Attorney, Agent, or Firm*—Banner & Witcoff, Ltd

(57) ABSTRACT

An image forming apparatus includes a disengagement unit that disengages all of plurality of image carrier gears and plurality of driving, gears, and allows an image carrier unit to be removed outside of an unit containing portion.

20 Claims, 9 Drawing Sheets

IMAGE FORMING APPARATUS AND IMAGE CARRIER UNIT WITH GEARS FOR DRIVING IMAGE CARRIERS

CROSS-REFERENCE TO RELATED APPLICATIONS

This application claims the benefit of Japanese Patent Application No. 2006-053065 filed Feb. 28, 2006 in the Japan Patent Office, the disclosure of which is incorporated herein by reference.

BACKGROUND

The present invention relates to an image forming apparatus including: an image carrier unit integrally having a plurality of image carriers, which respectively carries an image; and a unit containing portion which removably contains the image carrier unit. The present invention also relates to a technique associated with the image forming apparatus.

Some type of a conventional laser printer includes a photoreceptor unit, having a plurality of photoreceptor drums integrally aligned in one direction, and a unit containing portion, wherein the photoreceptor unit can be removably contained along the alignment direction of the photoreceptor drums.

In this type of laser printer, drum gears are provided and respectively connected to the photoreceptor drums so as to transmit driving force to the photoreceptor drums for rotating the drums. Moreover, a plurality of driving gears is provided in the unit containing portion. The driving gears are engaged with the respective drum gears so as to transmit driving force to the drum gears from a motor.

Generally, in this type of laser printer, when the photoreceptor unit is removed while a user lifting an end portion of the photoreceptor unit in a downstream side of the removal direction, the drum gears and the driving gears are disengaged in a consecutive manner from the downstream side.

The drum gears and the driving gears are formed in such a manner that the center of each circle works as the center of rotation. However, in a precise sense, the center of rotation slightly deviates from the center of the circles. Therefore, the displacement rate on the outer circumference of the gears at the time of rotation (the displacement amount on the outer circumference per unit time) is not constant.

When images, carried by respective the photoreceptor drums, are sequentially superposed on a sheet of paper conveyed in the above-described laser printer, the respective images are misaligned due to the dislocation of the center of gear rotation. A solution is required so as to inhibit misalignment of images carried by the photoreceptor drums.

For this purpose, in the above-described laser printer, a phase reference point is predetermined for the respective gears based on the dislocation of the rotational center, and the phase differences between the adjacent drum gears and between the adjacent driving gears are set so as to be respectively constant.

SUMMARY

However, in the above-described laser printer, when the photoreceptor unit is removed and the drum gears and the driving gears are disengaged, the drum gears and the driving gears, especially in the upstream side of the removal direction, sometimes interfere with each other and are unintentionally rotated. As a result, a problem is caused wherein the phase differences between the adjacent drum gears and between the adjacent driving gears are changed.

One aspect of the present invention preferably provides a technique wherein, when an image carrier unit having a plurality of image carriers respectively carrying images is removed, image carrier gears, connected to rotational shafts of the image carriers, and driving gears, which transmit driving force to the image carrier gears, are inhibited from interfering from each other.

In one aspect of the present invention, an image forming apparatus includes an image carrier unit, a unit containing portion, a plurality of driving gears, and a disengagement unit. The image carrier unit includes a plurality of image carriers that is integrally disposed in the image carrier unit, respectively carries images, and respectively has rotational shafts. The image carrier unit further includes a plurality of image carrier gears connected to the rotational shafts. The plurality of image carrier gears transmits driving force to the plurality of image carriers so as to rotate the plurality of image carriers. The unit containing portion removably contains the image carrier unit. The plurality of driving gears is disposed in the unit containing portion, and respectively corresponds to the plurality of image carrier gears. Each of the plurality of driving gears is engaged with one of the plurality of image carrier gears that corresponds thereto so as to transmit driving force to the plurality of image carrier gears from a driving source. The disengagement unit disengages all the plurality of image carrier gears and the plurality of driving gears, and allows the image carrier unit to be removed outside of the unit containing portion.

In the image forming apparatus configured as above, the image carrier unit may become removal when all the image carrier gears and the driving gears are disengaged by the disengagement unit.

Therefore, the image carrier gears and the driving gears do not interfere with each other when the image carrier unit is removed.

In another aspect of the present invention, an image carrier unit includes a plurality of image carriers, a housing, a plurality of image carrier gears, and guided members. The plurality of image carriers respectively carries images, and has rotational shafts. The housing integrally supports the plurality of image carriers such that the plurality of image carriers are aligned along one direction and the rotational shafts are disposed in parallel to one another. The plurality of image carrier gears is respectively connected to the rotational shafts, and respectively engaged with a plurality of driving gears disposed in a unit containing portion of an image forming apparatus so as to transmit driving force for rotating the plurality of image carriers from a driving source to the plurality of image carriers via the plurality of driving gears. The guided members are guided by guide members disposed in the unit containing portion along a centerline direction directed from a rotational center of one of the plurality of driving gears to a rotational center of one of the plurality of image carrier gears that corresponds to the one of the plurality of drive gears.

The image carrier unit configured as above may be moved in the centerline direction by the guided members being guided by the guide members.

Therefore, by the above-described image carrier unit, the image carrier gears and the driving gears may be disengaged without the teeth of these gears interfering with each other.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

First Embodiment

<External Structure of Printer 100 in First Embodiment>

In the following, when the disposition order of a plurality of constituents is indicated, the start point of the order is set in the front side of a printer 100. That is, the constituent disposed in the moot front side of the printer 100 is referred to as the first one among the plurality of constituents.

Figure 1:
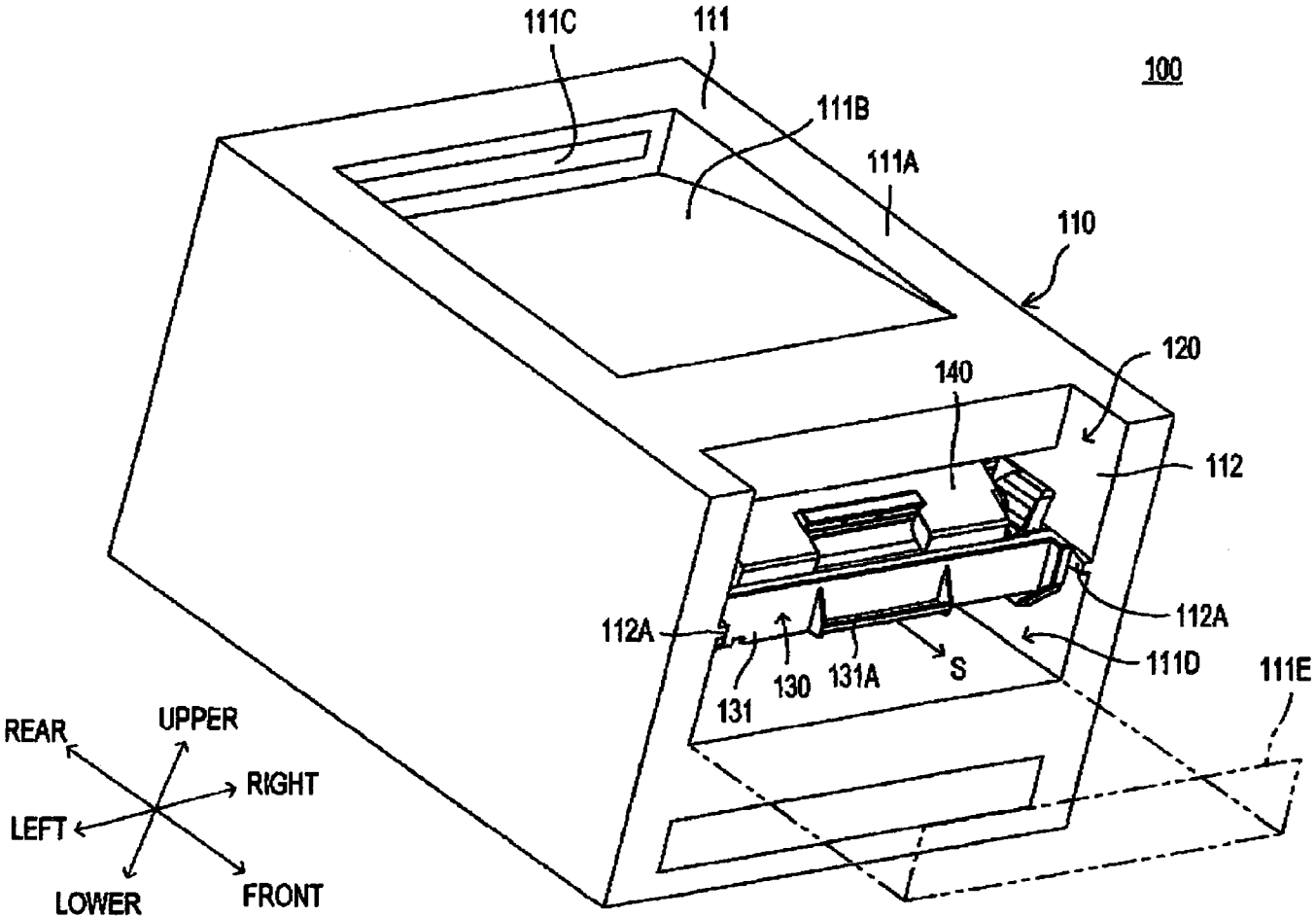
FIG. 1 is a perspective view showing an exterior appearance of a printer according to a first embodiment of the present invention.

As shown in FIG. 1, a body 110 of the printer 100 includes a body casing 111 and a body frame 112 contained inside of the body casing 111.

The body casing 111 is made of synthetic resin, and formed approximately in a rectangular parallelepiped shape. On a top surface 111A of the body casing 111, a paper discharge tray 111B is formed. The paper discharge tray 111B is downwardly inclined from the front side of the body casing 111 toward the rear side thereof. A paper discharge opening 111C is disposed in an upper portion of the body casing 111 above the rear end portion of the paper discharge tray 111B. Paper is discharged through the paper discharge opening 111C on to the paper discharge tray 111B.

In a front side of the body casing 111, a front opening 111D is formed. A front cover 111E is disposed in an openable/closable manner for closing the front opening 111D. The lower end of the front cover 111E is supported by the body casing 111.

The body frame 112 is configured so as to support various members provided for an image forming operation inside of the body 110. Driving sources and driving force transmission mechanisms are disposed inside of the body frame 112 for rotating and driving the various members.

The left inner wall and the right inner wall of the body frame 112 are respectively provided with guide rails 112A. More specifically, the respective guide rails 112A are disposed approximately horizontally from the front side of the printer 100 toward the rear side thereof.

In the body frame 112, an image forming unit 120 is installed such that the image forming unit 120 can be removed in a direction (shown with Arrow S in the figure) from the rear side of the printer 100 toward the front side thereof. In other words, the rear side of the printer 100 corresponds to the upstream side of the removal direction of the image forming unit 120, and the front side of the printer 100 corresponds to the downstream side of the removal direction.

<External Structure of Image Forming Unit 120>

Figure 2:
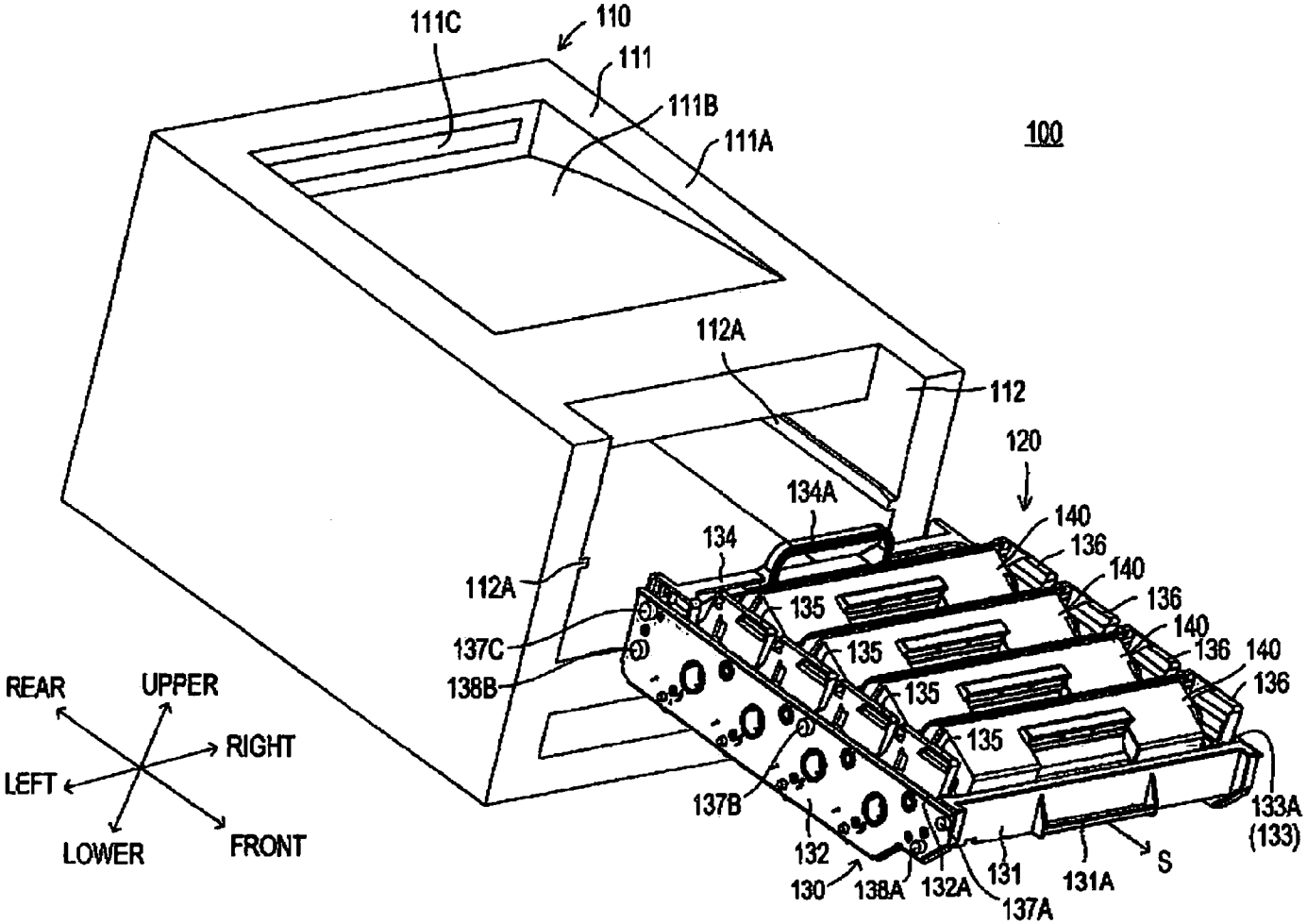
FIG. 2 is a perspective view showing the exterior appearance of the printer and an image forming unit in which the image forming unit is removed outside of the printer.

As shown in FIG. 2, the image forming unit 120 includes a drum unit 130, and four development cartridges 140.

The drum unit 130 includes a frame forming approximately a quadrangular plane with a front beam 131, a left supporting plate 132, a right supporting plate 133, and a rear beam 134.

More specifically, the front beam 131 and the rear beam 134, respectively provided in the front end side and in the rear end side of the drum unit 130, are disposed in parallel to each other. To the left and right ends of the respective front beam 131 and the rear beam 134, the left supporting plate 132 and the right supporting plate 133 are connected. In the inner side of the left supporting plate 132, four left plates 135 are aligned along the left supporting plate 132. In the inner side of the right supporting plate 133, four right plates 136 are aligned along the right supporting plates 133.

Between the left plates 135 and the right plates 136, the above-described development cartridges 140 are aligned from the front side of the drum unit 130 toward the rear side thereof. The development cartridges 140 are respectively supported by the left plates 135 and the right plates 136 in an attachable/detachable manner.

In the upper end portions of the left supporting plate 132 and the right supporting plate 133, flange portions 132A and 133A are respectively formed. The flange portions 132A and 133A are engaged with the above-described guide rails 122A when the drum unit 130 is inserted into the body frame 112.

In the upper portion on the respective outer walls of the left supporting plate 132 and the right supporting plate 133 (beneath the flange portions 132A, 133A), rollers 137A, 137B, and 137C are rotatably supported. (FIG. 2 shows only the rollers 137A, 137B, and 137C provided on the left supporting plate 132.)

More specifically, the rollers 137A, 137B, and 137C are respectively disposed in the front end portion, the center portion, and the rear end portion in the upper portion of the left supporting plate 132 and the right supporting plate 133. That is, the drum unit 130 is guided along the guide rails 112A in the front-to-rear direction of the body frame 112 by the rollers 137A, 137B, and 137C being rotated on the guide rails 112A. The diameters of the rollers 137A, 137B, and 137C are determined such that the diameters become larger in the order from the roller 137A, 137B, and 137C.

On the respective outer walls of the left supporting plate 132 and the right supporting plate 133, projection members 138A and 138B are disposed. (FIG. 2 shows only the projection members 138A and 138B provided on the left supporting plate 132.)

More specifically, the projection member 138A is disposed below and behind the roller 137A. The projection member 138B is disposed below and anterior to the roller 137C.

The drum unit 130 is provided with a front handle 131A in the front surface of the front beam 131. The drum unit 130 can be easily removed from the body frame 112 by a user pulling the front handle 131A toward the front side of the body frame 112.

The drum unit 130 is also provided with a rear handle 134A in the upper end portion of the rear beam 134. The drum unit 130 can be easily carried by a user holding the front handle 131A and the rear handle 134A.

Figure 3:
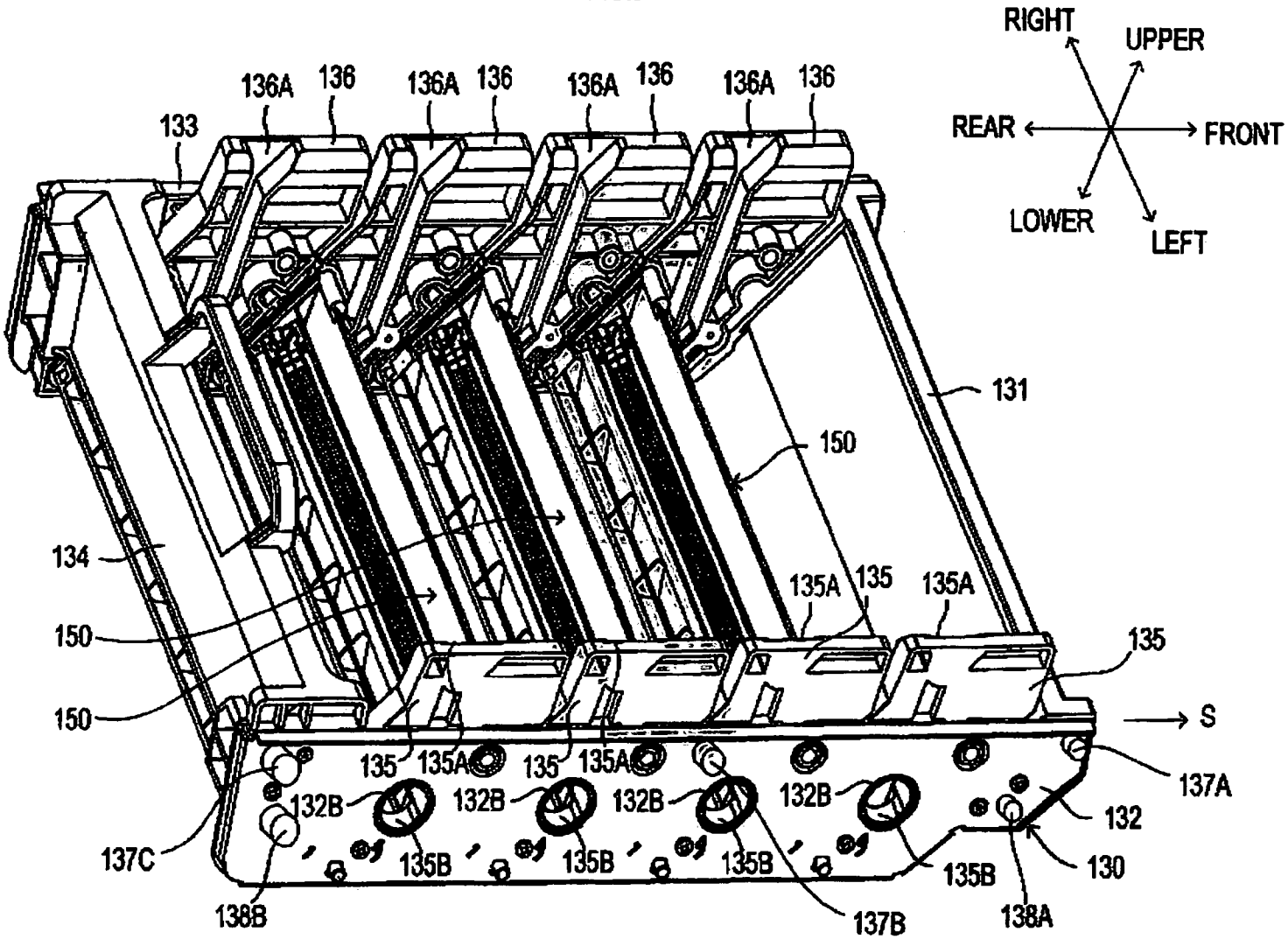
FIG. 3 is a perspective view showing an exterior appearance of a drum unit from which all development cartridges are removed.

As shown in FIG. 3, the left supporting plate 132 of the drum unit 130 is provided with four coupling insertion holes 132B along the disposition direction of the development cartridges 140 such that the respective coupling insertion holes 132B face the respective development cartridges 140.

Each of the left plates 135 is provided with a coupling exposure hole 135B in a position so that the coupling exposure hole 135B faces the coupling insertion hole 132B.

The coupling insertions holes 132B and the coupling exposure holes 135B are provided for inserting driving shafts (not shown) disposed within the body frame 112 so as to apply driving force to coupling receiving gears (not shown) disposed in the development cartridges 140.

On the respective inner walls of the left plates 135 and the right plates 136, guide grooves 135A, 136A are formed for guiding the development cartridges 140 in the up-and-down direction.

In the bottom portion of the drum unit 130, four drum portions 150 are disposed along the disposition direction of the development cartridges 140 (only first three drum portions 150 from the front side are shown in FIG. 3).

<Internal Structure of Printer 100>

Figure 4:
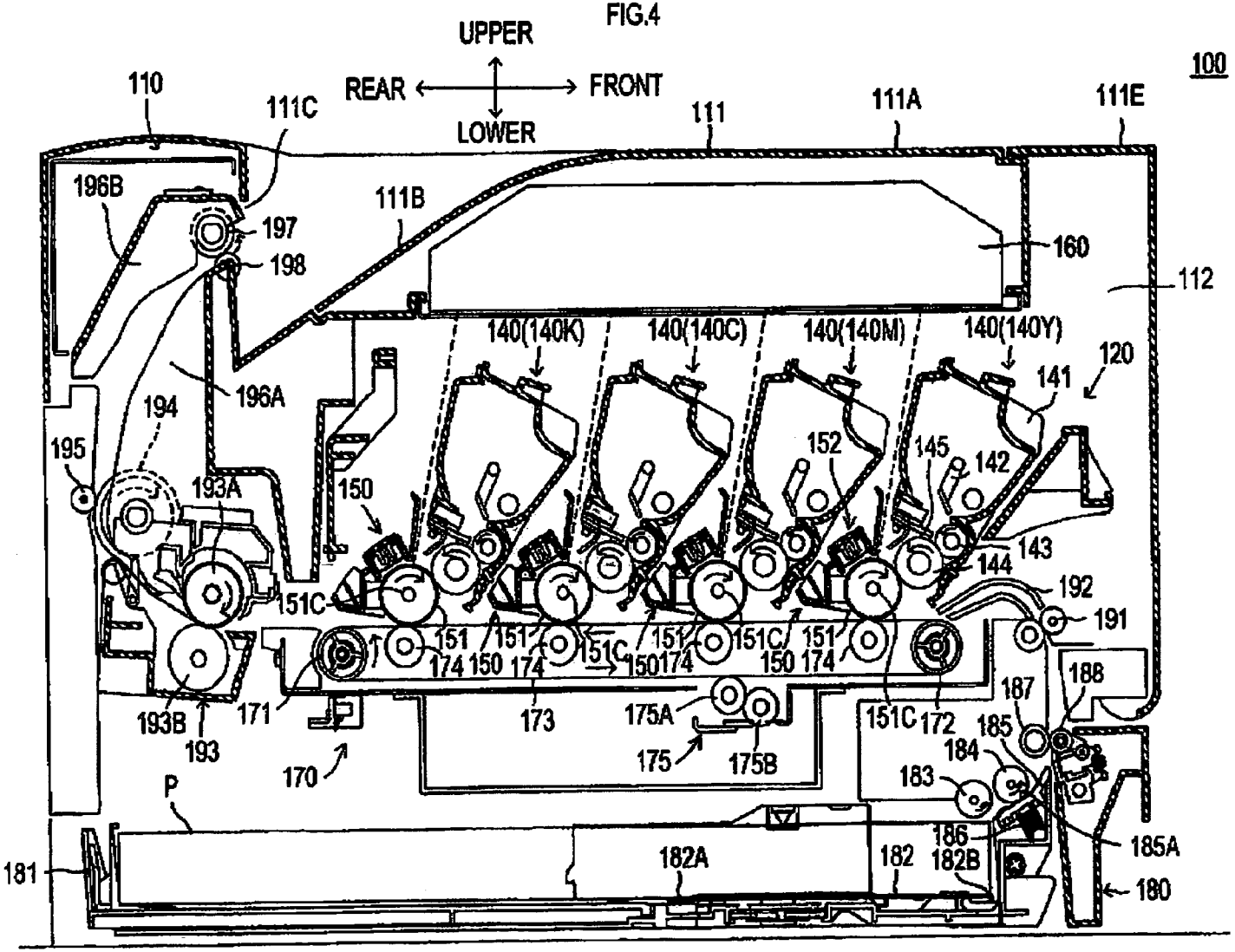
FIG. 4 is a cross sectional view showing an internal structure of the printer in which the image forming unit is installed.

As shown in FIG. 4, in the body 110 of the printer 100, the image forming unit 120 is disposed in the center portion thereof, and the paper discharge unit 193 is disposed behind the image forming unit 120.

The body 110 further includes a scanner unit 160, a transfer unit 170, and a feeder unit 180. The scanner unit 160 is disposed above the image forming unit 120. The transfer unit 170 is disposed below the image forming unit 120. The feeder unit 180 is disposed below the transfer unit 170.

<<Structure of Feeder Unit 180>>

The feeder unit 180 includes a feeder case 181, a feed roller 183, a separation roller 184, a separation pad 185, and a paper dust removal roller 187.

The feeder case 181 is formed in such a manner that sheets of paper P can be stacked inside thereof. In the feeder case 181, a paper pressing plate 182 is disposed. A rear end portion 182A of the paper pressing plate 182 is rotatably supported inside of the feeder case 181. That is, in the feeder case 181, a front end portion 182B of the paper pressing plate 182 is swayed approximately in the up-and-down direction in the figure.

The feed roller 183 is made of synthetic rubber. The feed roller 183 is rotatably supported above the front end portion 182B of the paper pressing plate 182 by the body frame 112. The feed roller 183 is driven so as to rotate in the counterclockwise direction in the figure, and conveys a sheet of paper P, stacked on the top inside of the feeder case 181, toward the front side of the feed roller 183.

The separation roller 184 is made of synthetic rubber in the same manner as the feed roller 183. The separation roller 184 is rotatably supported by the body frame 112 in the front side of the feed roller 183. The separation roller 184 is driven so as to rotate in the same direction as the feed roller 183, and conveys the sheet of paper P toward the front side thereof.

The separation pad 185 is disposed so as to face the separation roller 184. A separation surface 185A of the separation pad 185 facing the separation roller 184 is made of a material having a high friction coefficient, such as synthetic rubber, felt, and so on. Below the separation pad 185, a separation pad biasing spring 186 is disposed. By the separation pad biasing spring 186 biasing the separation pad 185 toward the separation roller 184, the separation roller 184 and the separation pad 185 are pressed against each other.

The paper dust removal roller 187 removes paper dust adhered to the sheet of paper P. The paper dust removal roller 187 is disposed above and in the front side of the separation roller 184 so as to face a pinch roller 188, and rotatably supported by the body frame 112.

<<Structure of Image Forming Unit 120>>

In the image forming unit 120, the four development cartridges 140 (140Y, 140M, 140C, and 140K) are aligned from the front side of the printer 100 toward the rear side thereof. Beneath the development cartridges 140, the four drum portions 150 are aligned from the front side of the printer 100 toward the rear side thereof, so as to face the development cartridges 140.

The four development cartridges 140Y, 140M, 140C, and 140K respectively contain toners (developers) in some colors different from one another, such as yellow, magenta, cyan, and black. Although the development cartridges 140Y, 140M, 140C, and 140K contain toners of different colors, the structures thereof are exactly the same.

More specifically, the development cartridges 140 respectively contain toners, which are developers for developing electrostatic latent images, in respective cartridge cases 141. The development cartridges 140 respectively include agitators 142, supply rollers 143, development rollers 144, and blades 145.

The agitator 142 stirs a toner contained in the cartridge case 141, and is rotatably supported by the cartridge case 141.

The supply roller 143 is made of a sponge roller, and rotatably supported by the cartridge case 141.

The development roller 144 is made of a rubber roller, and rotatably supported by the cartridge case 141. The supply roller 143 and the development roller 144 are disposed such that the supply roller 143 and the development roller 144 face each other and the periphery surfaces thereof contact with each other. The supply roller 143 is driven so as to rotate in the counterclockwise direction in the figure, and supplies an electrically-charged toner to the periphery surface of the development roller 144.

The blade 145 is disposed so as to abut on the periphery surface of the development roller 144. The blade 145 adjusts the amount of the toner supplied on to the periphery surface of the development roller 144, which is driven so as to rotate in the counterclockwise direction in the figure.

The four drum portions 150 are configured exactly in the same manner. The drum portions 150 respectively include photoreceptor drums 151 and scorotron chargers 152.

The photoreceptor drum 151 has a photoreceptive layer, made of a photoconductor, on the periphery surface thereof. The photoreceptor drum 151 is disposed such that the periphery surface thereof faces the periphery surface of the development roller 144 in the development cartridge 140.

The photoreceptor drum 151 is rotatably supported by the drum unit 130, and driven so as to rotate in the clockwise direction in the figure by a drive mechanism to be described later. However, the direction of the rotational shafts 151C of all the photoreceptor drums 151 is set to be perpendicular to the installation direction of the drum unit 130 in a horizontal plane (a direction perpendicular to the surface of the drawing). That is, all the rotational shafts 151C are disposed in parallel to one another.

The scorotron charger 152 is constituted so as to uniformly charge the periphery surface of the photoreceptor drum 151. The scrotron charger 152 is disposed above the photoreceptor drum 151 so as to face the periphery surface of the photoreceptor drum 151.

<<Structure of Scanner Unit 160>>

The scanner unit 160 is constituted 80 as to emit laser beam, generated based on image data, from a laser emission portion (not shown) on to the periphery surfaces of the photoreceptor drums 151. Also the scanner unit 160 is constituted so as to scan laser beam emitted therefrom in the width direction of the printer 100 (the direction perpendicular to the surface of FIG. 4).

<<Structure of Transfer Unit 170>>

The transfer unit 170 includes a belt driving roller 171, a driven roller 172, a conveyance belt 173, four transfer rollers 174, and a belt cleaner 175.

The belt driving roller 171 is disposed below and behind the drum portion 150 facing the development cartridge 140K disposed in the most rear side among the four development cartridges 140. The belt driving roller 171 is rotatably supported by the body frame 112.

The driven roller 172 is disposed below and in the front side of the drum portion 150 facing the development cartridge 140Y disposed in the most front side among the four development cartridges 140. The driven roller 172 is rotatably supported by the body frame 112.

The conveyance belt 173 is an endless belt made of a resin film, such as conductive polycarbonate or polyimide, wherein conductive particles, such as carbon, are dispersed. The conveyance belt 173 runs between the belt driving roller 171 and the driven roller 172.

The conveyance belt 173 is moved in the counterclockwise direction in the figure by the belt driving roller 171 being driven so as to rotate in the counterclockwise direction. The conveyance belt 173 conveys the sheet of paper P placed thereon along the disposition direction of the development cartridges 140.

The transfer rollers 174 are respectively disposed beneath the respective photoreceptor drums 151 so as to face the photoreceptive drums 151 of the drum portions 150 with the conveyance belt 173 inbetween. The transfer rollers 174 are rotatably supported by the body frame 112, and rotated corresponding to the conveyance belt 173 moving counterclockwise.

That is, each of the transfer rollers 174 holds the sheet of paper P by sandwiching the sheet of paper P with the photoreceptor drum 151 facing thereto, and transfers an image (a toner image) carried on the periphery surface of the photoreceptor drum 151 to the surface of the sheet of paper P. Furthermore, the transfer rollers 174 convey the sheet of paper P together with the photoreceptor drums 151 toward the rear side the printer 100.

The belt cleaner 175 is disposed beneath the second transfer roller 174 among the four transfer rollers 174. The belt cleaner 175 removes toner and paper dust adhered to the surface of the conveyance belt 173 by a pair of cleaning rollers 175A, 175B.

<<Structure of Paper Discharge Unit 193>>

The paper discharge unit 193 includes a heat roller 193A and a pressure roller 193B.

The heat roller 193A is constituted with a metal cylinder, having a surface treated with as mold release process, and a halogen lamp contained in the cylinder. The heat roller 193A is rotatably supported by the body frame 112.

The pressure roller 193B is made of silicone rubber, and disposed so as to be pressed against the heat roller 193A at predetermined pressure. The pressure roller 193B is rotatably supported by the body frame 112.

In the paper discharge unit 193, when the heat roller 193A is driven so as to rotate in the clockwise direction in the figure, the pressure roller 193B is correspondingly rotated in the counterclockwise direction. The sheet of paper P, conveyed from the transfer unit 170, is fed between the heat roller 193A and the pressure roller 193B, and conveyed behind the rollers 193A and 193B. As a result, a toner on the sheet of paper P melts and adheres (is fixed) to the sheet of paper P. Then, the sheet of paper P is conveyed toward the paper discharge opening 111C.

The paper discharge unit 193 furthermore includes a conveyance roller 194 for conveying the sheet of paper P on which toner is adhered, and a pinch roller 195. The conveyance roller 194 and the pinch roller 195 are disposed behind the heat roller 193A and the pressure roller 193B.

The conveyance roller 194 is rotatably supported by the body frame 112.

The pinch roller 195 is disposed so as to face the conveyance roller 194, and rotatably supported by the body frame 112.

By the conveyance roller 194 being driven so as to rotate in the clockwise direction in the figure, the pinch roller 195 is correspondingly rotated in the counterclockwise direction in the figure. As a result, the sheet of paper P is conveyed toward the paper discharge opening 111C.

The paper discharge unit 193 still further includes paper guides 196A, 196B disposed above the conveyance roller 194 and the pinch roller 195, for guiding the sheet of paper P with a toner adhered thereon.

The paper guides 196A and 196B guide the sheet of paper P, conveyed by the conveyance roller 194 and the pinch roller 195, toward the paper discharge opening 111C.

The paper discharge unit 193 further includes a paper discharge roller 197 and a paper discharge driven roller 198 both disposed in the vicinity of the paper discharge opening 111C.

The paper discharge roller 197 and the paper discharge driven roller 198 are disposed so as to face each other in the up-and-down direction in the figure, and respectively supported by the body frame 112 in a rotatable manner.

By the paper discharge roller 197 being driven so as to rotate in the counterclockwise direction in the figure, the paper discharge driven roller 198 is correspondingly rotated in the clockwise direction. As a result, the sheet of paper P is discharged outside of the body 110 from the paper discharge opening 111C.

<<Structure of Drive Mechanism and Removal Mechanism>>

Figure 5:
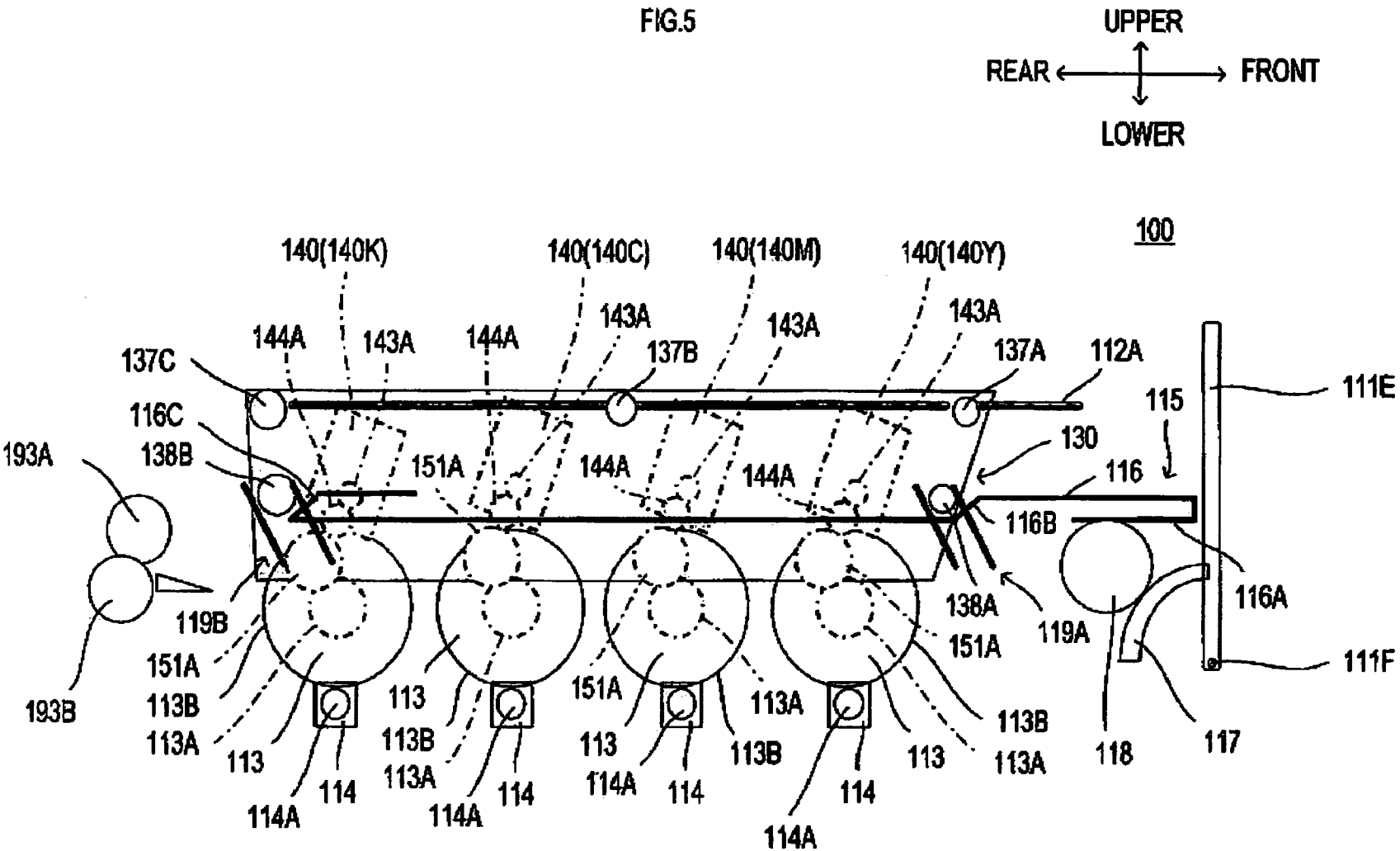
FIG. 5 is a schematic view showing a structure of a drive mechanism for driving various parts of the image forming unit as installed in a body frame of the printer, and a removal mechanism for removing the image forming unit from the body frame.

As shown in FIG. 5, the left outer walls of respective development cartridges 140 are provided with a supply roller driving gear 143A and a development roller driving gear 144A. The supply roller driving gear 143A is connected to the rotational shaft of the supply roller 143. The development roller driving gear 144A is connected to the rotational shaft of the development roller 144.

The respective teeth of the supply roller driving gear 143A and the development roller driving gear 144A are engaged with the teeth of the above-described coupling receiving gear. When driving force is applied from the above-described driving shaft to the coupling receiving gear, the supply roller driving gear 143A and the development roller driving gear 144A are correspondingly rotated. In other words, the supply roller driving gear 143A and the development roller driving gear 144A transmit driving force applied from the above-described driving axis to the supply roller 143 and the development roller 144.

Inside of the drum unit 130, four drum gears 151A are disposed so as to be respectively connected to the rotational shafts 151C of the photoreceptor drums 151. Phases of the respective drum gears 151A, which indicate rotational angles thereof, are determined with respect to reference rotational positions thereof. The reference rotational positions are set based on the locations of the rotational centers of the respective drum gears 151A. The rotational orientations of the respective drum gears 151A are set such that phase differences between the first and second drum gears 151A, between the second and third drum gears 151A, and between the third and fourth drum gears 151A are predetermined phase differences. The predetermined phase differences may be all the same, or be partly the same, or be different from each other.

The body frame 112 (not shown in FIG. 5) is provided with four body gears 113, constituted with two-stage gears: an inner gear 113A and an outer gear 113B. The body gears 113 are disposed beneath the drum unfit 130, and rotatably supported by the body frame 112.

More specifically, the body gears 113 are disposed along the disposition direction of the drum gears 115A. Each of the inner gears 113A of the body gears 113 is engaged with the teeth of the drum gear 151A disposed above and behind the inner gear 133A. In other words, each of the drum gears 151A is engaged with the inner gear 113A disposed below and in the front side of the drum gear 151A.

Phases of the respective body gears 113, which indicate rotational angles thereof, are determined with respect to reference rotational positions thereof. The reference rotational positions are set based on the locations of the rotational centers of the respective body gears 113. The rotational orientations of the respective body gears 113 are set such that phase differences between the first and second body gears 113, between the second and third body gears 113, and between the third and fourth body gears 113 are predetermined phase differences. The predetermined phase differences may be all the same, or be partly the same, or be different from each other.

The drum gears 151A receive reaction force from the inner gears 113A when the inner gears 113A are rotated. The reaction force has a direction at a predetermined angle (pressure angle: 20° in the present embodiment) with respect to a tangent line passing through the contact point between the pitch circle of the drum gear 151A and the pitch circle of the inner gear 113A.

If the inner gear 113A is disposed beneath the drum gear 151A in the perpendicular direction, the reaction force is applied to the drum gear 151A, which is directed toward 20° in the upper rear side with respect to the horizontal direction. As a result, the reaction force applied to the photoreceptor drum 151 lifts the photoreceptor drum 151. Therefore, maintaining suitable nip pressure between the photoreceptor drum 151 and the transfer roller 174 becomes difficult.

In the present embodiment, the inner gear 113A is disposed below and in the front side of the drum gear 151A as described above. Therefore, the reaction force can be directed along the conveyance direction of the sheet of paper P, and suitable nip pressure can be maintained between the photoreceptor drum 151 and the transfer roller 174.

Beneath the body gears 113, four drive motors 114 are disposed for the respective body gears 113. Motor gears 114A are connected to the rotational shafts of the respective drive motors 114. The teeth of the respective motor gears 114A are engaged with the teeth of the outer gears 113B of the corresponding body gears 113.

That is, when the drive motors 114 are driven, the body gears 113 and the drum gears 151A are correspondingly rotated and transmit the driving force, applied from the drive motors 114, to the photoreceptor drums 151.

On the respective guide rails 112A, holes are respectively formed in the front side, in the center portion, and in the rear side. The rollers 137A, 137B, and 137C are engaged with these holes.

The size of the respective holes in the front-to-rear direction is determined so as to be approximately equivalent to the diameter of the roller to be engaged therein. Therefore, when the rollers 137A, 137B, and 137C are rotated on the guide rails 112A, the rollers 137B and 137C do not become engaged with the hole for the roller 137A. The roller 137C likewise does not become engaged with the hole for the roller 137B.

Beneath the respective guide rails 112A, disengagement mechanisms 115 are disposed (only the disengagement mechanism 115 on the left side of the printer 100 is shown in FIG. 5) for disengaging all the drum gears 151A and the inner gears 113A.

More specifically, the respective disengagement mechanisms 115 include links 116, cover support members 117, operation gears 118, and disengagement guides 119A, 119B.

The links 116 are made of a rod-shaped member, and supported by the body frame 112 so as to be movable in the front-to-rear direction.

The length of the links 116 is such that the links 116 extend between the vicinity of the front end portion of the body frame 112 and the vicinity of the rear end portion thereof.

In the front end portion of the respective links 116, front bend portions 116A are formed. The front bend portion 116A is formed by the front end portion of the link 116 being bent downward and then bent backward. Teeth are provided on the bottom circumference of the front bend portion 116A.

The links 116 are also respectively provided with front inclined portions 116B in front of the projection member 138A of the drum unit 130 installed in the body frame 112. The front inclined portion 116B is made with a portion of the link 116 extending from in the front side of the projection member 138A to the position where the projection member 138A is disposed. This portion of the link 116 is inclined downward so as to form the front inclined portion 116B.

Furthermore, the links 116 are respectively provided with rear inclined portions 116C in front of the projection member 138B of the drum unit 130 installed in the body frame 112. The rear inclined portion 116C is made with the rear portion of the link 116 bent so as to be inclined upwardly toward the front side, and then bent such that the leading end of the rear end portion is directed toward the front side.

The cover support members 117 are formed in an arc shape, and disposed beneath the front bend portion 116A of the link 116.

The arcs of the respective cover support members 117 is directed toward the upper rear side, and provided with a plurality of teeth thereon. The front ends of the respective cover support members 117 are connected to the bottom portion of the front cover 111E. The cover support members 117 are rotated on the support shaft 111F of the front cover 111E when the front cover 111E is moved so as to open/close the front opening 111D.

The operation gears 118 are rotatably supported by the body frame 112 between the cover support member 117 and the front bend portion 116A of the link 116. The teeth of the operation gears 118 are respectively engaged with the teeth of the cover support members 117, and with the teeth of the front bend portions 116A of the links 116.

The disengagement mechanisms 119A, 119B are respectively disposed in the vicinity of the projection members 138A, 138B of the drum unit 130 installed in the body frame 112.

More specifically, the disengagement mechanisms 119A, 119B are configured with a pair of plate members sandwiching the projection members 138A and 138B. The direction of the plate members is determined so as to be in parallel to the direction of the center line extending from the center of the rotation of the body gear 113 (the center of the rotation of the inner gear 113A) to the center of the rotation of the drum gear 151A.

That is, the disengagement guides 119A, 119B respectively guide the projection members 138A, 138B along the direction of the center line.

By the disengagement mechanisms 115 configured as above, the image forming unit 120 is removed from the body frame 112 as follows.

The following describes the removal operation for removing the image forming unit 120 from the body frame 112 with reference to FIGS. 6A, 6B, 7A and 7B. It is to be noted that the front cover 111E, the cover support member 117, and the operation gear 118 are not shown in FIGS. 7A and 7B so as to simplify the description.

Figure 6A:
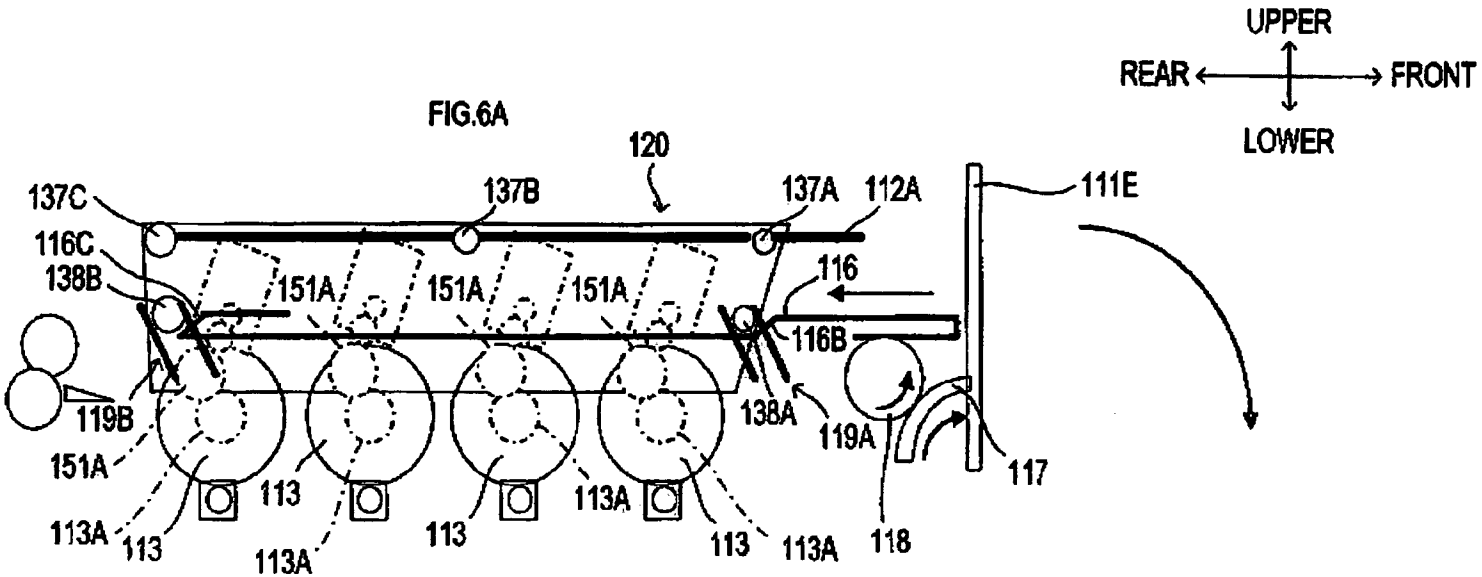
FIGS. 6A and 6B are explanatory views illustrating a removal operation for removing the image forming unit from the body frame.

As shown in FIG. 6A, as a user starts opening the front cover 111E, the cover support members 117 are rotated in the clockwise direction in the figure, and the operation gears 118 are rotated in the counterclockwise direction. Correspondingly, the links 116 are moved toward the rear side.

Figure 6B:
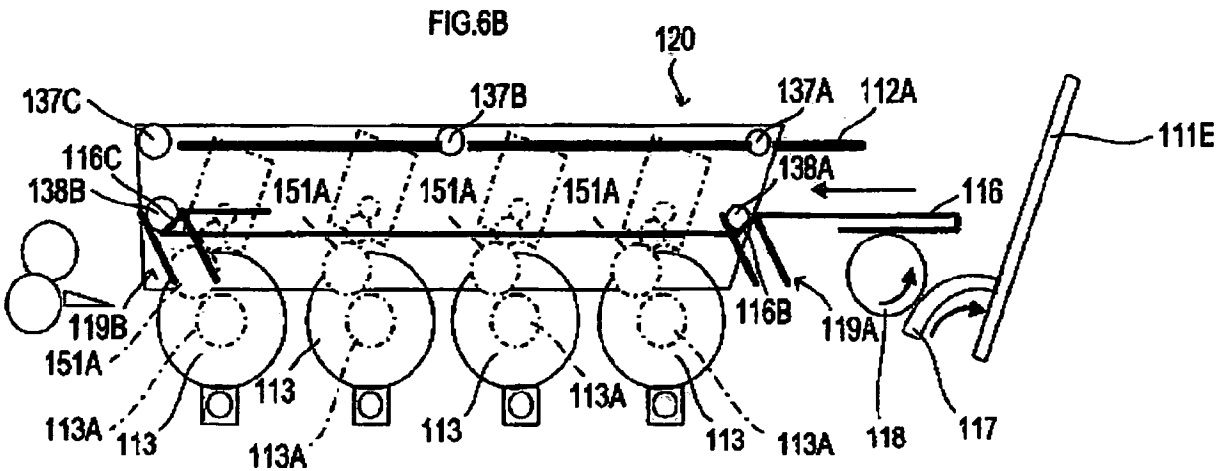

Then, as shown in FIG. 6B, as the user further opens the front cover 111E, the links 116 are further moved toward the rear side. The front inclined portions 116B are abutted, on the projection members 138A. Simultaneously, the rear inclined portions 116C are abutted on the projection members 138B.

Figure 7A:
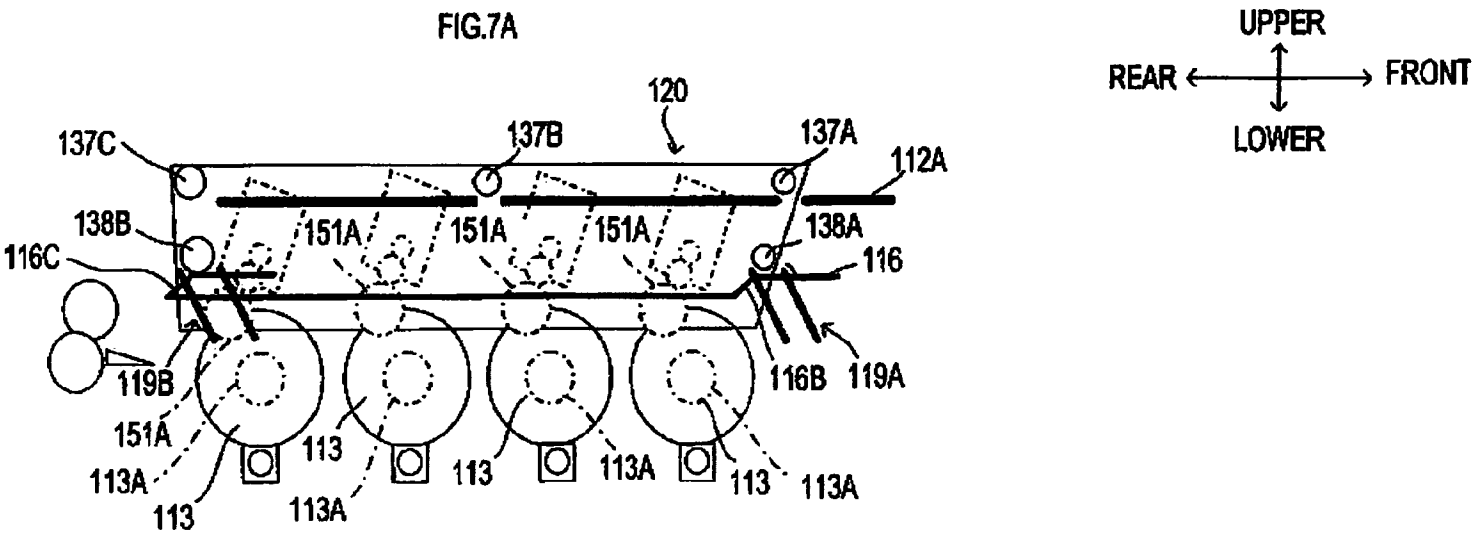
FIGS. 7A and 7B are explanatory views illustrating the removal operation for removing the image forming unit from the body frame.

As shown in FIG. 7A, when the user completely opens the front cover 111E, the links 116 are furthermore moved toward the rear side. The image forming unit 120 is guided by the disengagement guides 119A, 119B and lifted in the above-described centerline direction. As a result, all the drum gears 151A and the inner gears 113A are disengaged, and the rollers 137A, 137D, and 137C are removed from the above-described holes provided with the guide rails 112A.

Figure 7B:
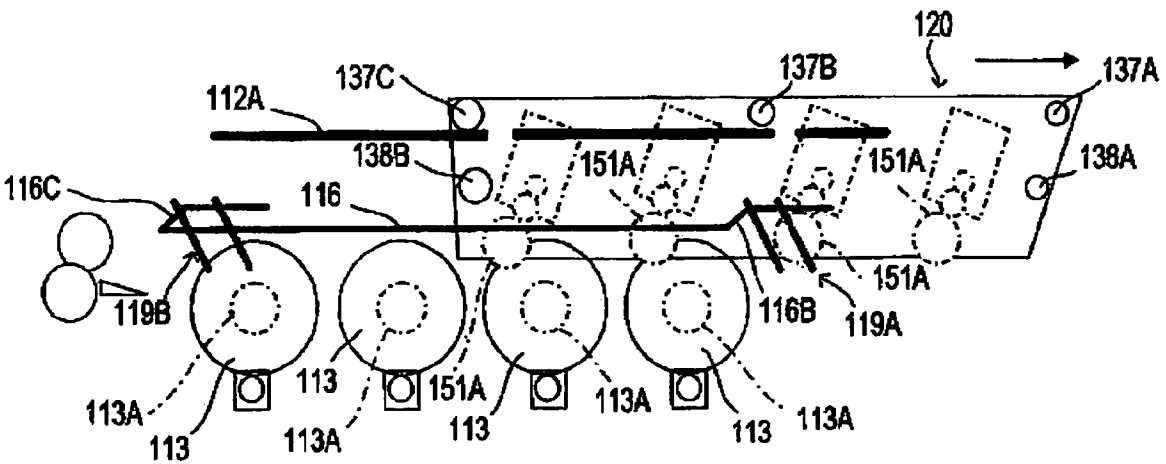

Subsequently, as shown in FIG. 7B, when the user pulls the image forming unit 120 toward the front side, the rollers 137A, 137B, and 137C are rotated on the guide rails 112A. The image forming unit 120 is guided by the guide rails 112A, and removed to the outside of the body frame 112.

Even when the image forming unit 120 is removed and all the drum gears 151A and the inner gears 113A are disengaged, if the teeth of the drum gears 151A and the inner gears 113A come in contact, the phase differences between the adjacent drum gears 151A and between the adjacent the body gears 113 become out of the predetermined phase differences.

Therefore, the inventor of the present invention calculated the minimum travel distance X for the disengagement mechanisms 116 to move the image forming unit 120.

The calculation will be described below with reference to FIG. 8.

Here, the pitch circle diameter of the drum gear 151A (the diameter of the circle with dotted line in the drum gear 151A) is represented as D1. The pitch circle diameter of the inner gear 113A (the diameter of the circle with dotted line in the inner gear 113A) is represented as D2.

The size of the module of the drum gear 151A (the distance between the circle with the dotted line in the drum gear 151A and the circle with the full line) and the size of the module of the inner gear 113A (the distance between the dotted line in the inner gear 113A and the circle with the full line) are determined to be equivalent, and represented as M.

The angle between the centerline direction and the direction perpendicular to the removal direction of the image forming unit 120 is θ.

Figure 8:
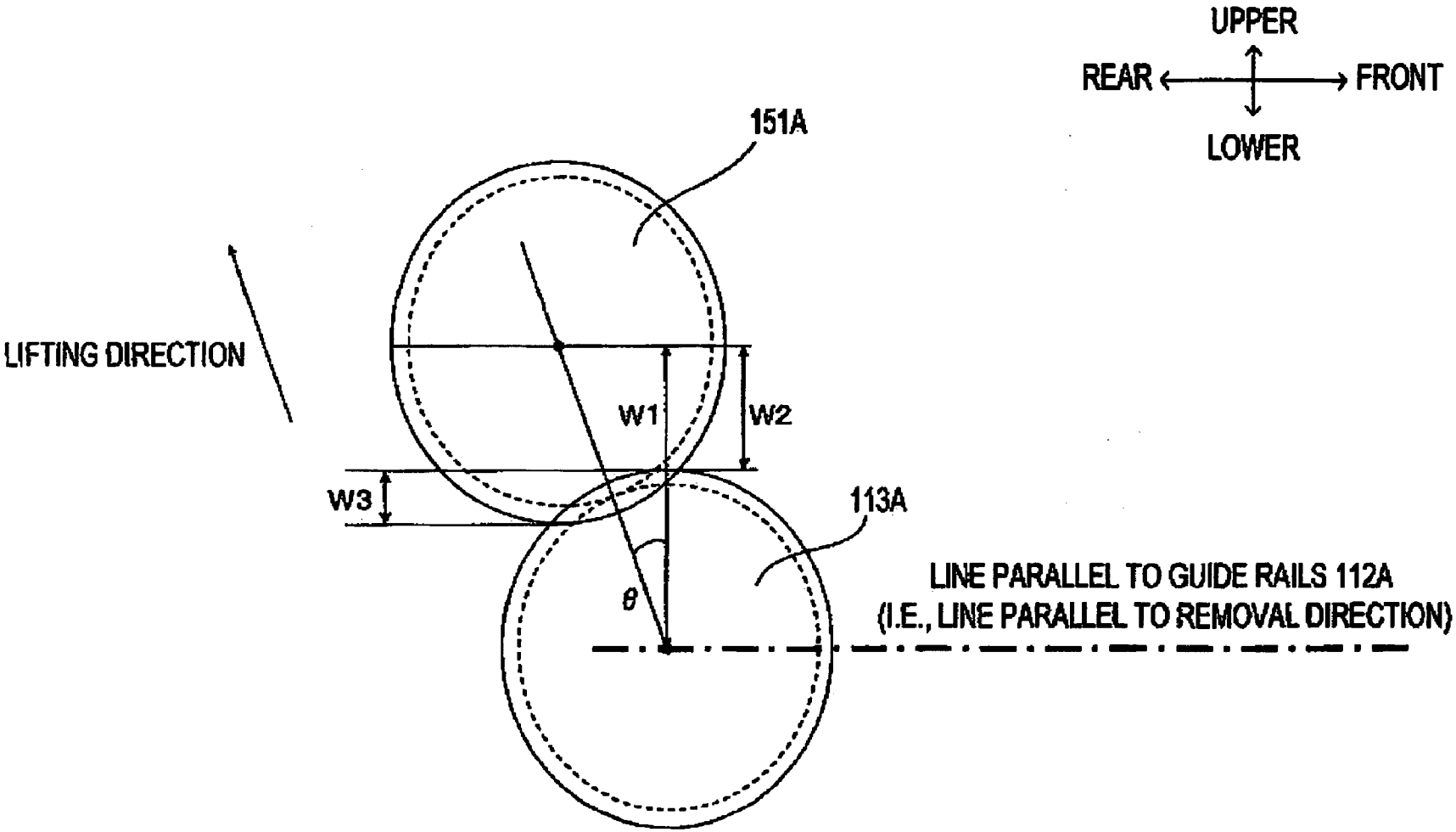
FIG. 8 is an explanatory view showing an engagement between a drum gear and an inner gear of the printer.

With using the various parameters determined as above, the distance W1 in the perpendicular direction, as shown in FIG. 8, between the straight line, drawn from the center of the drum gear 151A in parallel to the removal direction, and the dot-dash line, drawn from the center of the inner gear 113A in parallel to the removal direction, is obtained from:

$$W1=(D1+D2)\cos\theta/2$$

The distance W2 in the perpendicular direction between the straight line, drawn from the center of the drum gear 151A in parallel to the removal direction, and the tangent line, drawn tangentially to the circumference of the inner gear 131A in parallel to the removal direction, is obtained from:

$$\begin{aligned} W2 &= W1 - \{(D2/2) + M\} \\ &= [\{(D1 + D2)\cos\theta/2\} - \{(D2/2) + M\}] \end{aligned}$$

The distance W3 in the perpendicular direction between the above-described tangent line, drawn tangentially to the circumference of the inner gear 113A, and the tangent line, drawn tangentially to the circumference of the drum gear 151A in parallel to the removal direction, is obtained from:

$$\begin{aligned} W3 &= (D1/2) + M - W2 \\ &= \{(D1 + D2 + 4M) - (D1 + D2)\cos\theta\}/2 \end{aligned}$$

Therefore, the minimum travel distance X is obtained from:

$$\begin{aligned} X &= W3/\cos\theta \\ &= \{(D1 + D2 + 4M) - (D1 + D2)\cos\theta\}/2\cos\theta \end{aligned}$$

In the disengagement mechanisms 115, the height of the inclination of the front inclined portion 116B and the rear inclined portions 116C, and the length of the disengagement guides 119A, 119B are determined such that the image forming unit 120 is moved for at least the minimum travel distance X.

<Effects of Printer 100>

In the printer 100 according to the first embodiment, the image forming unit 120 becomes removable after all the dram gears 151A and the inner gears 113A are disengaged by the disengagement mechanisms 115. Therefore, the dram gears 151A and the body gears 113 do not interfere with each other when the image forming unit 120 is removed.

As a result, according to the printer 100, the phase differences between the adjacent dram gears 151A and between the adjacent body gears 113 can be inhibited from becoming out of the predetermined phase differences when the image forming unit 120 is removed.

Moreover, in the printer 100 according to the first embodiment, the dram gears 151A and the inner gears 113A are disengaged by moving the image forming unit 120 along the centerline direction. Therefore, the engagement can be performed without the teeth of the dram gears 151A and the inner gears 113A becoming in contact with each other. As a result, the phase differences can be reliably inhibited from becoming out of the predetermined phase differences. Additionally, the teeth of these gears can be inhibited from being worn away.

Furthermore, in the printer 100 according to the first embodiment, the disengagement mechanism 115 moves the image forming unit 120 at least for the above-described minimum travel distance X in the centerline direction. Therefore, once the disengagement of these gears is performed, the teeth of these gears do not contact with each other. As a result, the phase differences can be inhibited from becoming out of the predetermined phase differences, which may be caused by the teeth of these gears being in contact with each other when the image forming unit 120 is removed.

Still furthermore, in the printer 100 according to the first embodiment, the inner gears 113A are disposed below and in front of the drum gears 151A. Therefore, the angle, in which pressure is applied from the inner gears 113A to the drum gears 151A, conforms with the direction of conveyance of a sheet of paper P. As a result, in the printer 100 according to the present embodiment, suitable nip pressure can be maintained between the photoreceptor drum 151 and the transfer roller 174.

Moreover, in the printer 100 according to the present embodiment, the projection members 138A, 138B of the drum unit 130 are guided by the disengagement guides 119A, 119B in the body frame 112. Therefore, the image forming unit 120 can be reliably moved along the centerline direction.

In addition, the projection members 138A, 138B are provided respectively in the front side and rear side of the drum unit 130, and the disengagement guides 119A, 119B are provided respectively in the front side and the rear side in the body frame 112. Therefore, the image forming unit 120 can be stably moved along the centerline direction.

Moreover, in the printer 100 according to the present embodiment, guide rails 112A are provided in the body frame 112, and the rollers 137A, 137B, and 137C, rotated on the guide rails 112A, are provided in the drum unit 180. Therefore, the image forming unit 120 can be stably removed outside of the body frame 112.

Furthermore, in the printer 100 according to the present embodiment, all the drum gears 115A and the inner gears 113A are simultaneously disengaged. Therefore, the image forming unit 120 can be efficiently removed from the body frame 112.

Additionally, in the printer 100 according to the present embodiment, all the drum gears 151A and the inner gears 113 are disengaged at the same time when a user opens the front cover 111E. Therefore, a user can remove the image forming unit 120 immediately after opening the front opening 111D.

Second Embodiment

A printer 200 according to a second embodiment can be simply obtained by partially modifying the structure of the above-described printer 100 according to the first embodiment. Accordingly, the same reference numbers are used to components that are the same as in the printer 100 according to the first embodiment, and the descriptions thereof are not repeated here.

<Structure of Disengagement Mechanism>

Figure 9:
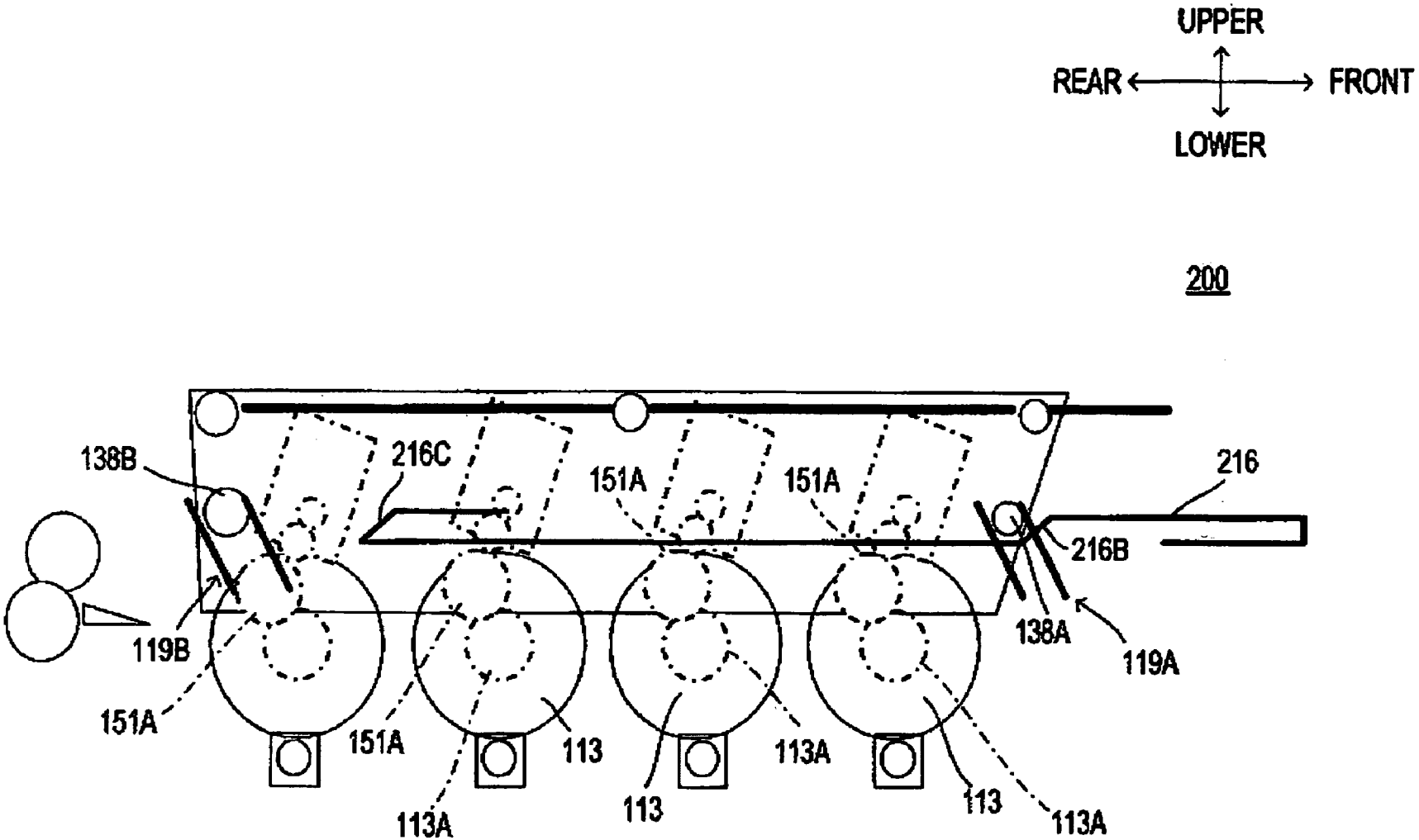
FIG. 9 is a schematic view showing a structure of a disengagement mechanism of a printer according to a second embodiment of the present invention.

The following describes the structure of the disengagement mechanism in the printer 200 with reference to FIG. 9. It is to be noted that the front cover 111E, the cover support member 117, and the operation gears 118 are not shown in FIG. 9, in order to simplify the description.

As shown in FIG. 9, the printer 200 includes links 216, instead of the links 116 of the printer 100 according to the first embodiment.

The links 216 are different from the links 116 in a way that the length thereof is shorter than the links 116.

In the printer 200 configured as above, when the links 216 are pushed toward the rear side by a user opening the front cover 111E, firstly, the front inclined portions 216B of the links 216 are abutted on the projection members 138A. Then, the front side of the image forming unit 120 is guided by the disengagement guide 119A, and lifted in the centerline direction.

When the user further opens the front cover 111E and thereby pushes the links 216 toward the rear side, the rear inclined portions 216C are abutted on the projection members 138B. Subsequently, the rear side of the image forming unit 120 is guided by the disengagement guides 119B, and lifted in the above-described centerline direction.

Therefore, in the printer 200, the drum gears 151A and the inner gears 113A are sequentially disengaged from the front side of the drum unit 130.

<Effect of Printer 200>

In the printer 200 according to the second embodiment, the drum gears 151A and the inner gears 113A are sequentially disengaged from the front side. Therefore, even if the image forming unit 120 is heavy, a large load is not applied on the link 216 at a time. As a result, a user can easily disengage these gears.

[Variation]

Although specific embodiments have been illustrated and described herein, it is to be understood that the above description is intended to be illustrative, and not restrictive. Combinations of the above embodiments and other embodiments will be apparent to those of skill in the art upon reviewing the above description. The scope of the invention includes any other applications in which the above structures are used. Accordingly, the scope of the invention should only be determined with reference to the appended claims, along with the full scope of equivalents to which such claims are entitled.

For example, the inner gears 113A of the above described printers 100 and 200 are disposed below and in front of the drum gears 151A. However, the inner gears 113A can be disposed in an alternative position, such as below and behind the drum gears 151A.

What is claimed is:

1. An image forming apparatus comprising:

an image carrier unit including a plurality of image carriers that is integrally disposed in the image carrier unit, respectively carries images, and respectively has rotational shafts, and a plurality of image carrier gears connected to the rotational shafts, the plurality of image carrier gears transmitting driving force to the plurality of image carriers so as to rotate the plurality of image carriers:

a unit containing portion that removably contains the image carrier unit;

a plurality of driving gears disposed in the unit containing portion, and respectively corresponding to the plurality of image carrier gears, each of the plurality of driving gears being engaged with one of the plurality of image carrier gears that corresponds thereto so as to transmit driving force to the plurality of image carrier gears from a driving source;

a disengagement unit that disengages all the plurality of image carrier gears and the plurality of driving gears, and allows the image carrier unit to be removed outside of the unit containing portion.

2. The image forming apparatus as set forth in claim 1 wherein the disengagement unit is constituted so as to inhibit the plurality of driving gears and the plurality of image carrier gears from being rotated, when the plurality of driving gears and the plurality of image carrier gears are disengaged.

3. The image forming apparatus as set forth in claim 1, wherein the plurality of image carriers are aligned along one direction, wherein the rotational shafts of the plurality of image carriers are disposed in parallel to each other, and wherein the plurality of driving gears are disposed along an alignment direction of the plurality of image carriers.

4. The image forming apparatus as set forth in claim 3 wherein the unit containing portion is constituted so as to remove the image carrier unit along an alignment direction of the plurality of the image carriers.

5. The image forming apparatus as set forth in claim 4, wherein the plurality of driving gears are respectively disposed with respect to the plurality of image carrier gears in an identical manner, and wherein the disengagement unit moves the image carrier unit along a centerline direction directed from a rotational center of one of the plurality of driving gears to a rotational center of one of the plurality of image carrier gears that corresponds to the one of the plurality of driving gears, and thereby disengages the plurality of image carrier gears and the plurality of driving gears.

6. The image forming apparatus as set forth in claim 5, wherein sizes of modules in the plurality of image carrier gears and in the plurality of driving gears are equivalent to each other, wherein the centerline direction is directed toward a predetermined angle with respect to a direction perpendicular to a removal direction of the image carrier unit, and wherein the disengagement unit moves the image carrier unit along the centerline direction at least for a distance obtained from:

$$\{(D1+D2+4M)-(D1+D2)\cos\theta\}/2\cos\theta$$

wherein D1 represents a pitch circle diameter of the image carrier gears, D2 represents a pitch circle diameter of the driving gears, M represents the size of the module of the image carrier gears and the driving gears, and θ represents the predetermined angle.

7. The image forming apparatus as set forth in claim 5 wherein the unit containing portion comprises a plurality of transferors that holds a recording medium by sandwiching the recording medium with the plurality of image carriers so as to transfer images carried by the plurality of image carriers, and to convey the image recording medium to a direction opposite to a removal direction of the image carrier unit, and wherein each of the plurality of driving gears is disposed in a downstream side of the removal direction with respect to one of the plurality of image carrier gears that corresponds thereto.

8. The image forming apparatus as set forth in claim 5 wherein the disengagement unit comprises:

guide members disposed in the unit containing portion so as to guide the image carrier unit along the centerline direction; and guided members disposed in the image carrier unit so as to be guided by the guide members.

9. The image forming apparatus as set forth in claim 8, wherein the guide members are disposed respectively in an upstream side and a downstream side of a removal direction of the image carrier unit, contained in the unit containing portion, and wherein the guided members are disposed respectively in the upstream side and the downstream side of the removal direction.

10. The image forming apparatus as set forth in claim 8, wherein the unit containing portion comprises rail members that guide the image carrier unit along a removal direction of the image carrier unit, and wherein the image carrier unit comprises slide members to be positioned on the rail members, when the image carrier unit is guided by the guide members along the centerline direction and slid on the rail members.

11. The image forming apparatus as set forth in claim 1 wherein the disengagement unit simultaneously disengages all the plurality of image carrier gears and the plurality of driving gears.

12. The image forming apparatus as set forth in claim 4 wherein the disengagement unit sequentially disengages the plurality of image earner gears and the plurality of driving gears from a downstream side toward an upstream side of a removal direction of the image carrier unit.

13. The image forming apparatus as set forth in claim 1 wherein the disengagement unit is operated in correspondence with a removal operation of the image carrier unit in which the image carrier unit, contained in the unit containing portion, is removed outside of the unit containing portion.

14. The image forming apparatus as set forth in claim 1 further comprising an open/close unit that opens/closes the unit containing portion, wherein the disengagement unit is operated in correspondence with the unit containing portion being opened by the open/close unit.

15. The image forming apparatus as set forth in claim 4 further comprising an open/close unit that opens/closes a downstream end of the unit containing portion in a removal direction of the image carrier unit, wherein the disengagement unit is operated corresponding to the unit containing portion beings opened by the open/close unit.

16. The image forming apparatus as set forth in claim 1 wherein the plurality of image carriers carries images in predetermined colors.

17. An image carrier unit comprising:

a plurality of image carriers that respectively carries images, and has rotational shafts;

a housing that integrally supports the plurality of image carriers such that the plurality of image carriers are aligned along one direction and the rotational shafts are disposed in parallel to one another;

a plurality of image carrier gears respectively connected to the rotational shafts, and respectively engaged with a plurality of driving gears disposed in a unit containing portion of an image forming apparatus so as to transmit driving force for rotating the plurality of image carriers from a driving source to the plurality of image carriers via the plurality of driving gears;

guided members to be guided by guide members disposed in the unit containing portion along a centerline direction directed from a rotational center of one of the plurality of driving gears to a rotational center of one of the plurality of image carrier gears that corresponds to the one of the plurality of drive gears.

18. The image carrier unit as set forth in claim 17 wherein the guided members are disposed respectively in an upstream side and a downstream side of a removal direction of the image carrier unit contained in the unit containing portion.

19. The image carrier unit as set forth in claim 17 wherein the plurality of image carriers carries images in predetermined colors.

20. An image forming apparatus comprising:

an image carrier unit including a plurality of image carriers that is integrally disposed in the image carrier unit, respectively carries images, and respectively has rotational shafts, and a plurality of image carrier gears connected to the rotational shafts, the plurality of image carrier gears transmitting driving force to the plurality of image carriers so as to rotate the plurality of image carriers:

a unit containing portion that removably contains the image carrier unit;

a plurality of driving gears disposed in the unit containing portion, and respectively corresponding to the plurality of image carrier gears, each of the plurality of driving gears being engaged with one of the plurality of image carrier gears that corresponds thereto so as to transmit driving force to the plurality of image carrier gears from a driving source;

a disengagement unit that disengages all the plurality of image carrier gears and the plurality of driving gears such that the plurality of image carrier gears and the plurality of driving gears become mutually decoupled, and allows the image carrier unit to be removed outside of the unit containing portion.

* * * * *